US011806562B2

(12) United States Patent
Nötzel et al.

(10) Patent No.: US 11,806,562 B2
(45) Date of Patent: Nov. 7, 2023

(54) PNEUMATIC CONTROL DEVICE FOR MULTI-ZONE FIRE EXTINGUISHING SYSTEMS, AND MULTI-ZONE FIRE-EXTINGUISHING SYSTEMS HAVING SAME

(71) Applicant: Minimax GmbH, Bad Oldesloe (DE)

(72) Inventors: Thomas Nötzel, Lübeck (DE); Thomas Claessen, Kaarst (DE)

(73) Assignee: Minimax GmbH, Bad Oldesloe (DE)

( * ) Notice: Subject to any disclaimer, the term of this patent is extended or adjusted under 35 U.S.C. 154(b) by 712 days.

(21) Appl. No.: 16/771,655

(22) PCT Filed: Dec. 19, 2018

(86) PCT No.: PCT/EP2018/085998
§ 371 (c)(1),
(2) Date: Jun. 10, 2020

(87) PCT Pub. No.: WO2019/122022
PCT Pub. Date: Jun. 27, 2019

(65) Prior Publication Data

US 2021/0069539 A1 Mar. 11, 2021

(30) Foreign Application Priority Data

Dec. 19, 2017 (DE) ..... 10 2017 130 587.4

(51) Int. Cl.
*A62C 37/46* (2006.01)
*A62C 35/68* (2006.01)
*A62C 37/40* (2006.01)

(52) U.S. Cl.
CPC ..... *A62C 37/46* (2013.01); *A62C 35/68* (2013.01); *A62C 37/40* (2013.01)

(58) Field of Classification Search
CPC ..... A62C 35/02; A62C 35/11; A62C 35/13; A62C 35/68; A62C 37/40; A62C 37/44; A62C 37/46
See application file for complete search history.

(56) References Cited

U.S. PATENT DOCUMENTS 2,023,569 A 12/1935 Scott et al.
2,399,553 A * 4/1946 Lindsay ..... A62C 3/08 251/30.01

(Continued)

FOREIGN PATENT DOCUMENTS

DE 10 2010 013805 A1 10/2011
EP 0 574 663 A1 12/1993

(Continued)

OTHER PUBLICATIONS

International Search Report, International Application No. PCT/EP2018/085998 (published under WO 2019/122022), 7 pages (dated Mar. 4, 2019).

*Primary Examiner* — Darren W Gorman
(74) *Attorney, Agent, or Firm* — Perkins Coie LLP

(57) ABSTRACT

The invention concerns a pneumatic control device (1) for multi-zone fire extinguishing installations, comprising a control pressure inlet port (25) for connection to a control pressure source (105), in particular a pressurised gas container, a number (m) of first control pressure outlet ports (17) for connection to a corresponding number of extinguishing agent containers (107), a number (n) of second control pressure outlet ports (19) for connection to a corresponding number of zone valves (111), and a plurality of function modules (7, 9). It is proposed that the invention further includes a quantity control module (9) for the association of a selection of the first number of control pressure outlet ports (17) with a selection of the second control pressure outlet ports (19), and an electrical control valve module (7) which (Continued)

is controllable from the exterior for selectively opening or closing the second control pressure inlet ports (19) and which can be connected in particular in signal-conducting relationship to a fire alarm and/or extinguishing control station (103), wherein the function modules (7, 9) are operatively connected together.

18 Claims, 7 Drawing Sheets

(56) References Cited

U.S. PATENT DOCUMENTS

| | | | | |
|---|---|---|---|---|
| 5,857,525 | A * | 1/1999 | Okamoto | A62C 35/02 169/11 |
| 8,678,101 | B2 * | 3/2014 | Gatsonides | A62C 35/02 169/61 |
| 2004/0055764 | A1 | 3/2004 | Bowyer et al. | |
| 2013/0269784 | A1 * | 10/2013 | Dahlgren | F16K 1/308 137/553 |
| 2013/0284465 | A1 * | 10/2013 | Broidy | A62C 35/68 169/51 |
| 2017/0014655 | A1 * | 1/2017 | Gatsonides | B64C 19/00 |

FOREIGN PATENT DOCUMENTS

| | | |
|---|---|---|
| EP | 2 186 546 A1 | 5/2010 |
| EP | 2 289 600 A1 | 3/2011 |
| EP | 2 998 002 A1 | 3/2016 |
| EP | 3 117 875 A1 | 1/2017 |

* cited by examiner

PNEUMATIC CONTROL DEVICE FOR MULTI-ZONE FIRE EXTINGUISHING SYSTEMS, AND MULTI-ZONE FIRE-EXTINGUISHING SYSTEMS HAVING SAME

PRIORITY CLAIM AND INCORPORATION BY REFERENCE

This application is a 35 U.S.C. § 371 application of International Application No. PCT/EP2018/085998, filed Dec. 19, 2018, which claims the benefit of German Application No. 10 2017 130 587.4 filed Dec. 19, 2017, each of which is incorporated by reference in its entirety.

TECHNICAL FIELD

The invention concerns a pneumatic control device for multi-zone fire extinguishing installations. The invention further concerns a multi-zone fire extinguishing installation comprising a plurality of fire identification detectors which are respectively arranged in a region of an object to be monitored, a fire alarm and/or extinguishing control station connected in signal-conducting relationship to the fire identifier detectors, a number of extinguishing agent containers, a piping network connected to the extinguishing agent containers for transporting the extinguishing agent, wherein the piping network has a number of zone valves, and a control pressure source, in particular a pressurised gas container. The invention further concerns a quantity control module and an electrical control valve module for a multi-zone fire extinguishing installation.

BACKGROUND AND SUMMARY OF THE INVENTION

Multi-zone fire extinguishing installations (also referred to hereinafter as fire extinguishing installations) of the above-indicated kind are generally known. They are used in order in particular in relatively large objects to be monitored, to supply a plurality of regions or zones, also referred to as sectors, with extinguishing agent as required. In practice the zones to be monitored by the fire extinguishing installations are frequently of different sizes so that in the case of necessary fire fighting, different quantities of extinguishing agent have to be provided depending on the respective zone. As it is impracticable to design a dedicated fire extinguishing installation for each zone in general there is provided a central provisioning of the extinguishing agent, from which actuation and interconnection with the control pressure source is implemented individually for each zone by means of many individual components.

It is found in that respect that this involves the disadvantage that many installation steps are respectively required on site at the object for the large number of components used, and a complex pneumatic installation has to be provided. This involves protracted assembly, and maintenance as well as a low level of flexibility in respect of the extinguishing agent quantity control. It can however be necessary, for example upon changes in the circumstances in the individual zones in regard to the need for extinguishing agent, to perform a modification to the installation configuration in order for example to alter the associated amount of extinguishing agent for a zone of the installation. A high degree of expert knowledge is necessary for assembling and maintaining the known multi-zone fire extinguishing installations. In addition by virtue of the complexibility there is a certain degree of probability of mistakes being made upon assembly, and a significant space requirement. Corresponding considerations apply in regard to the control systems of the installation.

With that background in mind the object of the invention is to provide a possible way in a multi-zone fire extinguishing installation of overcoming the above-indicated disadvantages to the best possible extent. In particular the object of the invention is to reduce the installation expenditure and effort and to simplify flexibility in regard to the association of quantities of extinguishing agent with the individual zones of the multi-zone fire extinguishing installation.

The invention attains the object thereof by providing a control device. The invention proposes a pneumatic control device for multi-zone fire extinguishing installations, comprising a control pressure inlet port for connection to a control pressure source, in particular a pressurised gas container, a number of first control pressure outlet ports for connection to a corresponding number of extinguishing agent containers, a number of second control pressure outlet ports for connection to a corresponding number of zone valves, and a plurality of function modules including a quantity control module for the association of a selection of the first number of control pressure outlet ports with a selection of the second control pressure outlet ports, and an electrical control valve module which is controllable from the exterior for selectively opening or closing the second control pressure outlet ports and which can be connected in particular in signal-conducting relationship to a fire alarm and/or extinguishing control station, wherein the function modules are operatively connected together.

The invention for the first time provides a control device which groups the various functions for the association and control of the extinguishing agent outlet port with the various zones into compact modules. The modular structure affords the advantage that the control device according to the invention can be pre-fitted and in the pre-fitted state, that is to say when the modules are operatively connected, it represents when considered from the point of view of installation procedure a single component in which many control functions are integrated. That not only ensures that the various functions of the function modules are compactly brought together, but it also permits time-saving and cost-saving installation. Furthermore in comparison with the state of the art only a few control signals are to be supplied from the exterior in order to operate the control device.

Insofar as reference is made according to the invention to a pressurised gas container that preferably means a pressurised gas container with carbon dioxide, compressed air or a nitrogen filling.

In a preferred embodiment the function modules are combined to form a unit.

An advantageous development of the invention provides that the control valve module has an electronic control unit which is connected by means of a corresponding interface in signal-conducting relationship to the fire alarm and/or extinguishing control station, wherein the electronic control unit is preferably disposed in the control valve module. Alternatively or in addition the control unit can be in the form of an attachable control module which is reversibly releasably connected to the control valve module.

The function modules of the control device are preferably reversibly coupled to each other by means of at least one corresponding connector, in particular by means of a fluid-conducting connection between the function modules, which is fluid-tightly outwardly. Particularly preferably the function modules are designed to be pluggable. That provides for extremely quick and variably configuratable prefabrication of the control device for the respective situation of use of the multi-zone fire extinguishing installation.

In a preferred embodiment the quantity control module has a plurality of first flow paths between the control pressure inlet port and the first control pressure outlet ports and in each first flow path further has a shut-off element which can selectively adopt a closed state in which the respective first flow path is closed or an open state in which the respective first flow path is opened. Preferably in that case each shut-off element has an optical indicator which displays the closed or open state. Particularly preferably the shut-off element is in the form of a plug element which, in particular in the manner of a quick-action connection, can be inserted into a receiving socket of the quantity control module and can be arrested therein by means of a locking arrangement. Preferably the shut-off element is of such a configuration that in a first orientation in the inserted state in the quantity control module it defines the closed state and in a second orientation in the inserted state in the quantity control module it defines the open state. The shut-off element can be for example a non-return element mounted in a cylindrical sleeve.

In a further preferred embodiment therefore the shut-off elements are in the form of non-return valves which are fitted into a receiving socket, wherein a first orientation of the non-return elements produces the open position and a second orientation produces the closed position. The receiving sockets are preferably provided in the distributor blocks.

In preferred configurations the first number of control pressure outlet ports includes two or more outlet ports and the second number of control pressure outlet ports also includes two or more outlet ports.

In preferred embodiments the shut-off elements are fitted in distributor blocks, wherein the distributor blocks are mounted in mutually adjoining relationship and have flow passages to the respectively adjacent distributor blocks. The distributor blocks can preferably be fluid-tightly and reversibly releasably connected together, particularly preferably being adapted to be pluggable. The flow passages of adjacent distributor blocks are preferably respectively connected together in fluid-conducting relationship and fluid-tightly in relation to the exterior.

Preferably the distributor blocks are of such a configuration that each distributor block accommodates either two or three shut-off elements. By virtue of a serial sequential arrangement of a plurality of distributor blocks a selection of a suitable number of dual or triple blocks makes it possible to combine together any number of two or more flow passages on the control device. At the same time this permits a very low degree of diversity of components in terms of manufacture, which affords considerable synergy effects in mass production.

In a further preferred embodiment the shut-off elements are arranged in a switching matrix with a first number of rows and a second number of columns. Preferably the number of rows corresponds to the number of second control pressure outlet ports while the number of columns corresponds to the number of first control pressure outlet ports.

Further preferably the quantity control module for each row has flow passages and also for each column flow passages. The (first) flow paths pass between the control pressure inlet port and the first outlet ports through said flow passages, and the shut-off elements are respectively arranged at a crossing between a row having a flow passage and a column having a flow passage in order in the open position to enable a transfer from the respective rows into the respective columns and in the closed position to block the transfer.

In a second aspect which at the same time is an advantageous development of the first aspect and is an independent subject the invention concerns a control device for a multi-zone fire extinguishing installation, with an electrical control valve module which can be connected in signal-conducting relationship to a fire alarm and/or extinguishing control station and which is controllable by means of same.

Preferably the control valve module has the second control pressure outlet ports, and a plurality of second flow paths between the control pressure inlet port and the second control pressure outlet ports, wherein for each of the second control pressure outlet ports there is a control valve which is arranged between the control pressure inlet port and the second control pressure outlet ports and is reciprocatingly switchable between an open position and a closed position.

Preferably the first and second control paths extend jointly to the respective control valve in the control valve module and branch from each other downstream thereof.

Further preferably the control valve module has a number of third flow paths and connected thereto third control pressure outlet ports for connection to a corresponding number of alarm means, in particular Makrofons, and wherein the third control pressure outlet ports branch from the second flow path downstream of the control valves. The number of the third control pressure outlet ports preferably corresponds to the number of the second control pressure outlet ports and thus the number of the zones to be monitored.

Preferably the control valve module in each of the second flow paths downstream of the branching to the third flow paths has a blocking element for selectively shutting off one, more or all of the second control pressure outlet ports.

In a further preferred embodiment the control device has a fire extinguishing release module as a further function module, which is arranged in adjoining relationship downstream of the quantity control module, and for each first control pressure outlet port has a release valve which is preferably arranged upstream at the first control pressure outlet ports and is reciprocatingly switchable between an open position and a closed position. The term adjoining relationship is preferably used to mean a directly adjoining arrangement, in particular the extinguishing agent release module is reversibly releasably and fluid-tightly connected to the control device, particularly preferably by means of a plug-in connection.

In further preferred embodiments the release valves of the control device are pilot-controlled by means of a delay valve, wherein the delay valve can preferably be connected to a control pressure supply by means of a fourth flow path, wherein further preferably the fourth flow path branches from the first or second flow path.

In a further preferred configuration the control device has a service/reserve switching module as a further function module, which is arranged preferably downstream at the quantity control valve, preferably in adjoining relationship downstream of the extinguishing agent release module, and is adapted to fluid-conductingly connect the first control pressure outlet ports selectively to a number of service extinguishing agent containers or a number of reserve extinguishing agent containers. The connection is preferably effected by means of a respective control pressure line. In regard also to the service/reserve switching module the term adjoining arrangement is preferably used to mean a directly adjoining arrangement, in particular in the form of a reversibly releasable coupling, preferably in the form of a plug-in connection, which is of an outwardly fluid-tight configuration.

The invention has been described hereinbefore with reference to the control device according to the invention on the basis of a number of aspects. In a further aspect however the invention self-evidently also concerns multi-zone fire extinguishing installations of the kind set forth in the opening part of this specification.

In the case of a multi-zone fire extinguishing installation of the kind set forth in the opening part of this specification the object of the invention is attained in that the fire extinguishing installation has a control device which is connected in signal-conducting relationship to the fire alarm and/or extinguishing control station and is controllable by same, and which is in accordance with one of the above-described preferred embodiments of the first or second aspect. The multi-zone fire extinguishing installation involves the same advantages and preferred embodiments as the control device according to the invention, for which reason attention is directed to the foregoing description for the avoidance of repetition.

In a further aspect the invention concerns the quantity control module itself. In that respect the invention proposes a quantity control module for a multi-zone fire extinguishing installation, which is in the form of a standalone device or which alternatively is preferably adapted to be operatively connected to one or more further function modules to provide a control device according to one of the above-described preferred embodiments, wherein the quantity control module is adapted to associate a selection of a first number of control pressure outlet ports of the control device with a selection of second control pressure outlet ports of the control device, wherein the quantity control module has a plurality of (first) flow paths which are fluid-conducting connected in the coupled condition of the quantity control module to the control device to the (first) control pressure outlet ports and in each (first) flow path has a shut-off element which can selectively assume a closed state in which the respective (first) flow path is closed or an open state in which the respective (first) flow path is opened.

The quantity control module involves the same advantages and has the same preferred embodiments as the control device and the multi-zone fire extinguishing installation according to the above-described aspects so that in that respect reference is made to the foregoing description for the avoidance of repetition. Preferred embodiments of the control device are at the same time preferred embodiments of the quantity control module and vice-versa.

In a further aspect the invention concerns the electrical control valve module itself. In that respect the invention proposes an electrical control valve module for a multi-zone fire extinguishing installation, which is in the form of a standalone device or alternatively is preferably adapted to be operatively connected to a pneumatic control device according to one of the above-described preferred embodiments, wherein the control valve module is adapted to be controlled from the exterior for selectively opening or closing a number of second control pressure outlet ports of the control device, can be connected in particular in signal-conducting relationship in relation thereto to a fire alarm and/or extinguishing control station, wherein the control valve module can be preferably coupled to a quantity control module of the control device.

The electrical control valve module involves the same advantages and has the same preferred embodiments as the control device and the multi-zone fire extinguishing installation according to the above-described aspects so that in that respect reference is made to the foregoing description for the avoidance of repetition. Preferred embodiments of the control device are at the same time preferred embodiments of the electrical control valve module and vice-versa.

In a further aspect the invention proposes a method of installing a multi-zone fire extinguishing installation, in particular according one of the above described embodiments, including the steps:

- providing a quantity control module, in particular according one of the above described preferred embodiments,
- providing an electrical control valve module, in particular according one of the above described preferred embodiments,
- operatively connecting the quantity control module and the electrical control valve module to provide a control device, in particular according one of the above described preferred embodiments, and
- installing the control device formed in that way in the multi-zone fire extinguishing installation.

The method according to the invention involves in particular the above-described advantages of time and cost saving. The preferred embodiments of the above-described aspects are at the same time preferred embodiments of the method according to the invention and vice-versa so that reference is directed to the foregoing description for the avoidance of repetition.

BRIEF DESCRIPTION OF THE DRAWINGS

The invention is described in greater detail hereinafter with reference to the accompanying Figures by means of a preferred embodiment by way of example. In the Figures.

MODE(S) FOR CARRYING OUT THE INVENTION

Figure 1:
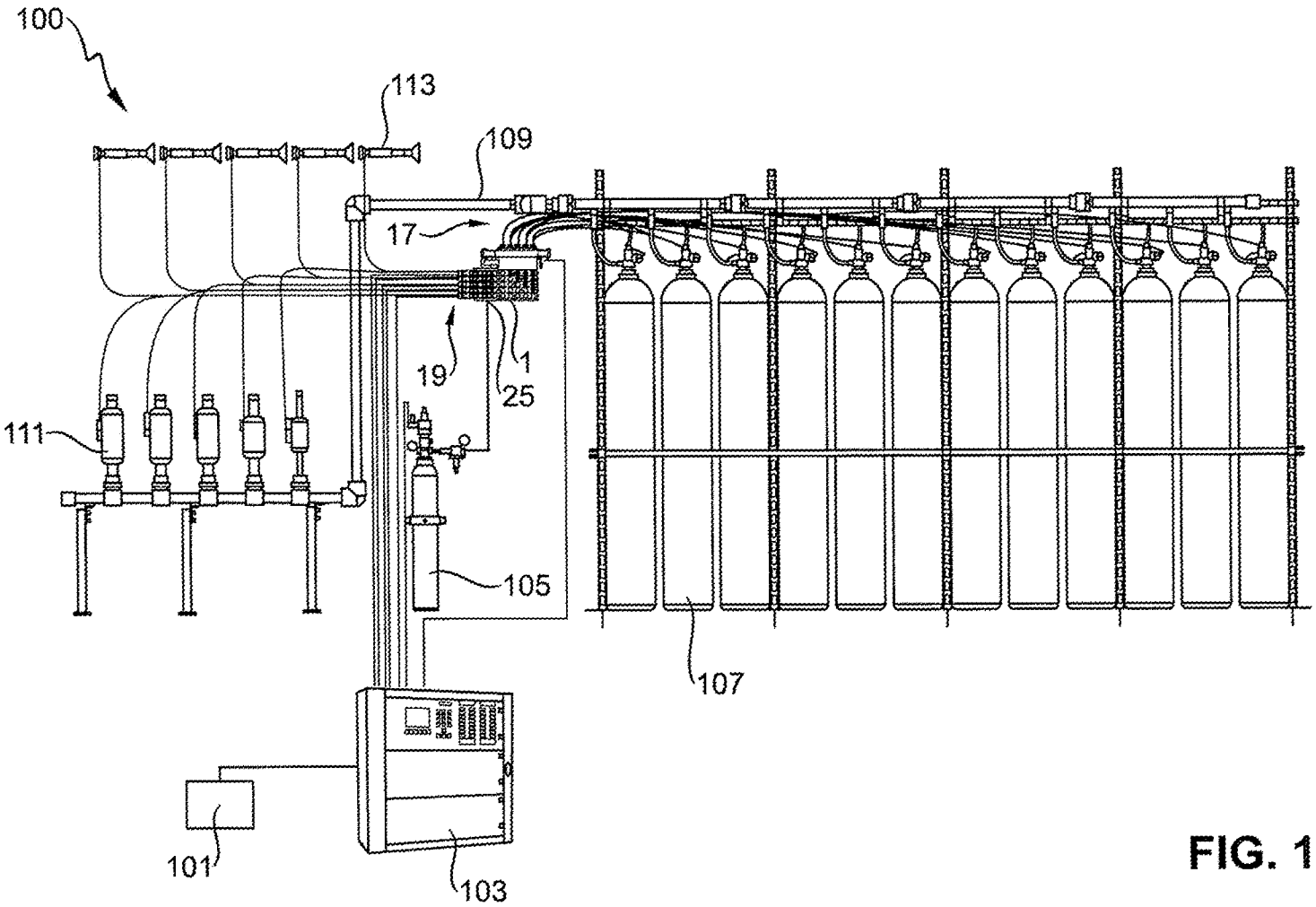
FIG. 1 shows a diagrammatic flow chart of a multi-zone fire extinguishing installation according to the invention.

FIG. 1 shows a fire extinguishing installation 100 which is in the form of a multi-zone fire extinguishing installation. The fire extinguishing installation 100 has a fire identifier detector 101 which is connected in signal-conducting relationship to a fire alarm and/or extinguishing control station 103. The fire extinguishing installation 100 further has a control pressure source 105 connected in fluid-conducting relationship to a control device 1 according to the invention. The control device 1 is connected in fluid-conducting relationship to the control pressure source 105 by way of a control pressure inlet port 25. In addition the control device 1 has a number of first control pressure outlet ports 17 and a number of second control pressure outlet ports 19.

The first control pressure outlet ports 17 are respectively connected in fluid-conducting relationship to a battery of extinguishing agent containers 107 or pneumatically actuable valves on the extinguishing agent containers 107.

The second control pressure outlet ports 19 of the control device 1 are connected in signal-conducting relationship to a respective zone valve 111. A zone valve 111 is respectively associated with a region of an object or building, that is to be monitored by the multi-zone fire extinguishing installation 100, and is actuated by means of the second control pressure outlet ports 19 of the control device.

The extinguishing agent containers 107 are connected in fluid-conducting relationship to the zone valves 111 by means of a piping network 109.

The fire extinguishing installation further has a number of alarm means 113 which are also actuated by means of control pressure from the control device 1 and are respectively associated with one of the zone valves 111.

When a fire is detected in one of the zones involving the zone valves 111 by the fire identifier detector 101 it sends a signal to the fire alarm and/or extinguishing control station 103 which in turn evaluates the signal from the fire identifier detector 101. After evaluation has been effected the fire alarm and/or extinguishing control station 101 actuates the control device 1 by means of an electrical signal. Control pressure is transmitted from the control pressure source 105 by way of the control device 1 to a number, predefined at the control device 1, of extinguishing agent containers 107, whereupon those containers open and discharge extinguishing agent by way of the pipeline network 109. In addition, by means of the control pressure, on the basis of the presettings of the control device, one or more of the zone valves 111 is opened in accordance with the detection by the fire identifier detector 101 in order to pass the extinguishing agent flowing into the pipeline network 109 into the corresponding zone. In addition the alarm means 113 associated with the zone valves 111, for example Makrofons, are triggered and preferably also supplied by means of control pressure from the control pressure source 105.

FIG. 1 only shows one fire identifier detector 101. Preferably one or more fire identifier detectors 101 are arranged in each of the zones of the multi-zone fire extinguishing installation 100 and are connected in signal-conducting relationship to the fire alarm and/or extinguishing control station 103.

Figure 2:
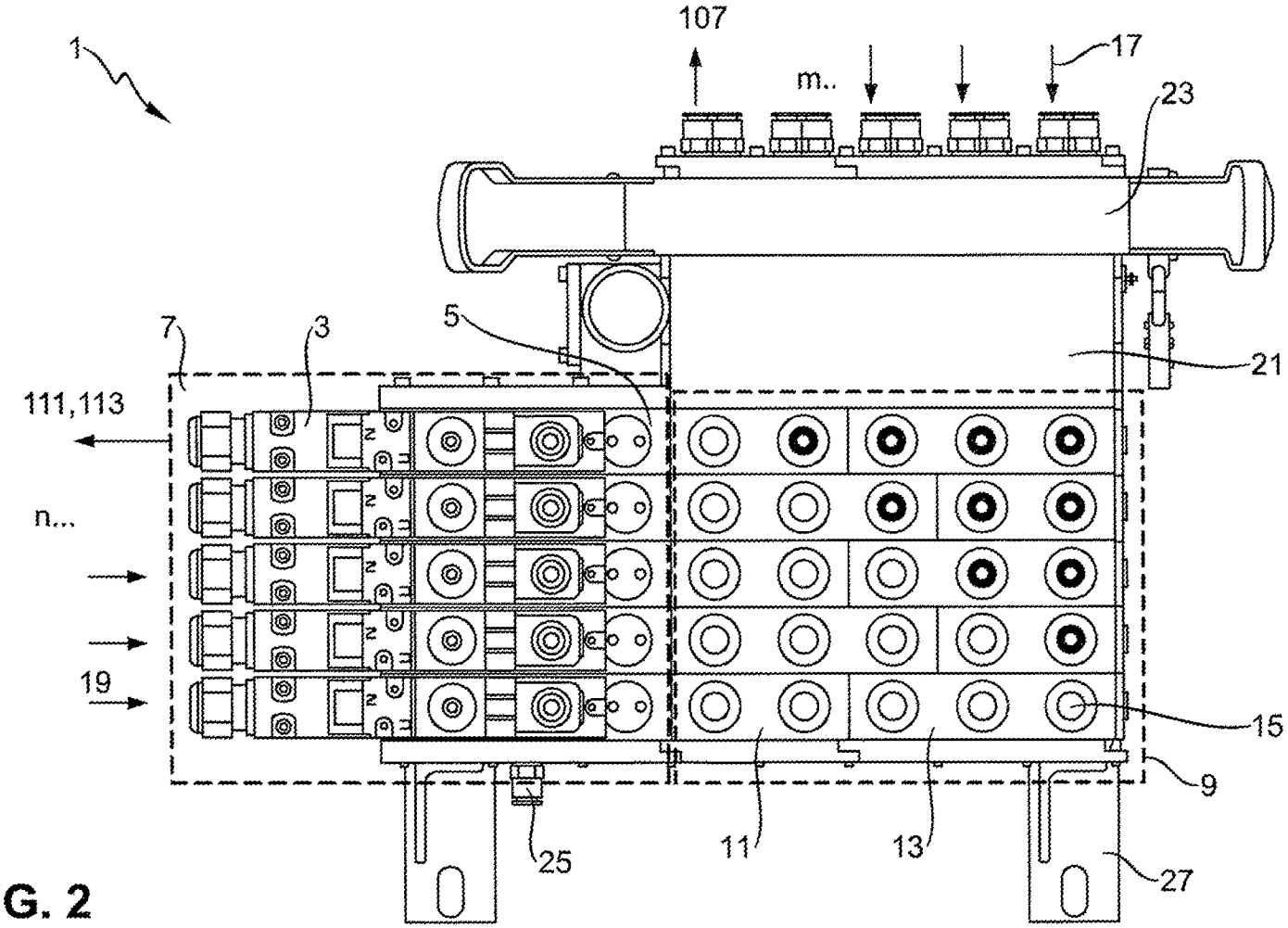
FIG. 2 shows a diagrammatic detail view of a control device as shown in FIG. 1.

The systematic structure of the control device 1 is shown in greater detail in FIG. 2. The control device has a control valve module 1 as a first function module, which has a plurality of control units 3 with a control valve housing 5. The second control pressure outlet ports 19 are provided at the control valve module 7, with a number n.

The control device 1 further has a second function module in the form of a quantity control module 9. The quantity control module 9 has a plurality of first distributor blocks 11 and second distributor blocks 13, the distributor blocks 11, 13 respectively having a plurality of shut-off elements 15.

Provided at the control device 1 are in total m first control pressure outlet ports 17 connected in fluid-conducting relationship to the quantity control module 9. Preferably an extinguishing agent release module 21 and a service/reserve switching module 23 are interposed between the first control pressure outlet ports 17 and the quantity control module 9.

The function modules 7, 9, 21 and 23 are preferably reversibly releasably coupled fluid-tightly in relation to the exterior by means of plug connectors and fixed to a main body 27 of the control device 1. The distributor blocks 11, 13 within the quantity control module 9 are preferably positioned in fluid-conducting relationship with each other by means of fluid-conducting connecting portions. The shut-off elements 15 are fitted into the valve blocks 11, 13 in the quantity control module 9 selectively in a closed position or an open position. In an open position a fluid-conducting connection is made between the first control pressure outlet ports 17 and the second control pressure outlet ports 19 while in the closed position such a fluid transfer is prevented. Any association between the first control pressure outlet ports 17 and the second control pressure outlet ports 19 is made possible by way of the m×n matrix of the shut-off elements 15 in the distributor blocks 11, 13. One or more second control pressure outlet ports 19 can be associated for each first control pressure outlet port 17 and vice-versa. That will also be still clearer from the following Figures.

Figure 3:
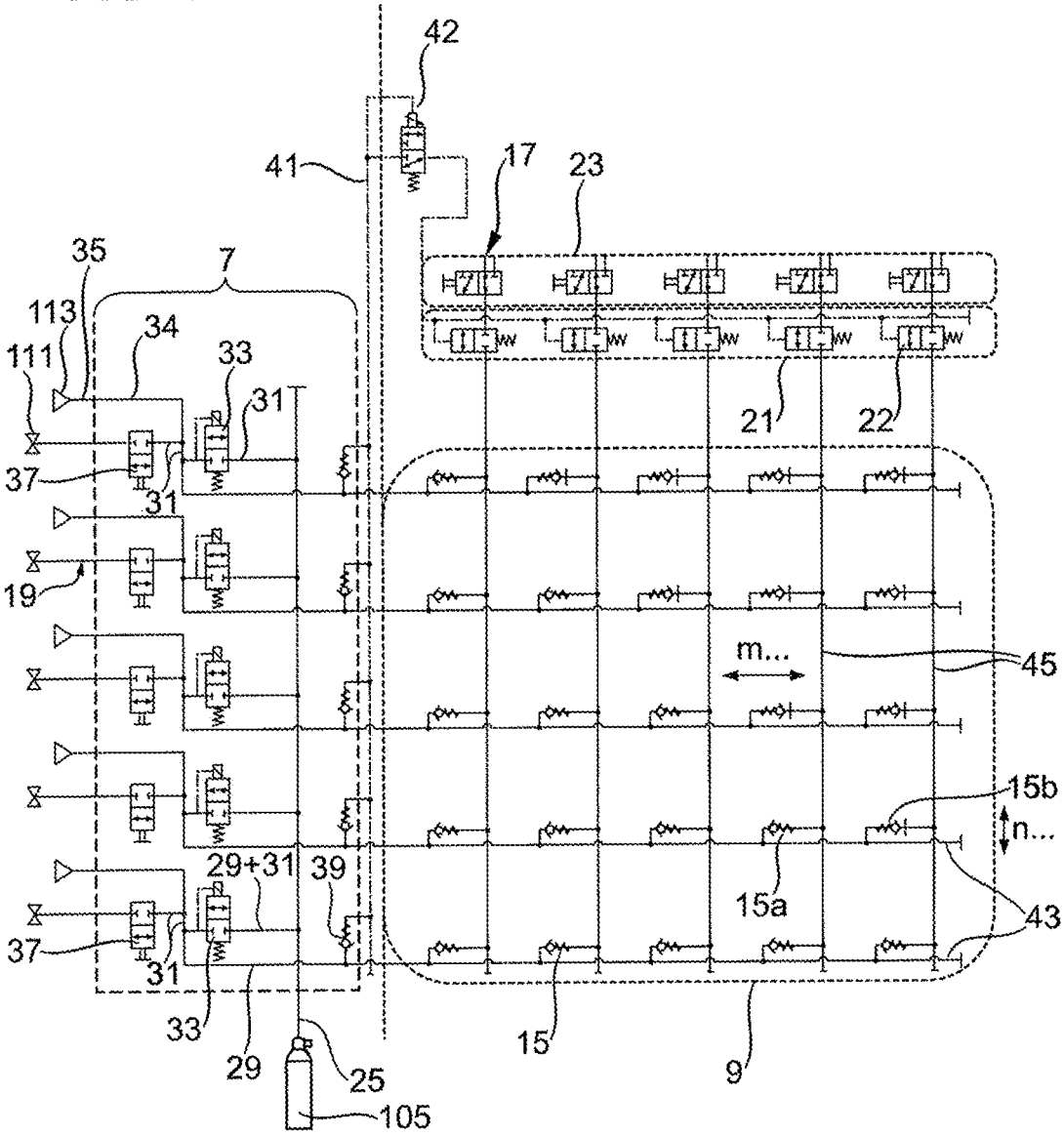
FIG. 3 shows a diagrammatic flow chart of the control device as shown in FIG. 2.

While FIG. 2 diagrammatically shows the structural configuration of the control device 1 FIG. 3 shows the control device 1 in the form of a diagrammatic flow chart.

The service/reserve switching module 23 is so switched in the illustrated switching position that the extinguishing agent containers 107 are connected to the control device 1 by way of the first control pressure outlet ports 17. By switching over it would be possible to connect a reserve in fluid-conducting relationship to the first control pressure outlet ports 17, instead of the extinguishing agent containers 107.

For each of the first control pressure outlet ports 17 the extinguishing agent release module 21 has a release valve 22 actuated by the control pressure from the control pressure source 105, preferably after delay by a delay valve 42.

On the part of the first control pressure outlet ports 19 FIG. 3 also shows the internal configuration of the control valve module 7 in greater detail. The control valve module 7 has a first flow path 29 between the quantity control module 9 and the second control pressure outlet ports 19 for each second control pressure outlet port 19. The first flow path 29 is adapted to transfer control pressure-pressurised gas in the direction of the quantity control module 9 and in the direction of the first control pressure outlet ports 17.

The control valve module 7 further has a plurality of second flow paths 31 provided between the control pressure inlet port 25 and the second control pressure outlet ports 19, wherein arranged for each of the second control pressure outlet ports 19 in the second flow path 31 is a control valve 33 which permits fluid transport in an open position between the control pressure inlet port 25 and the second control pressure outlet ports 19, and prevents same in a closed position. The first and second flow paths 29, 31 extend jointly to the respective control valve 33 and are designed to branch from each other downstream of the second control valve 33.

Furthermore, for each of the second control pressure outlet ports 19 the control valve module 7 has a blocking element 37 which is reciprocatingly switchable between an open position (not shown) and a closed position (shown). By means of closure of the blocking elements 37, it is possible to prevent opening of the zone valves 111 by the control pressure from the control pressure source 105. Thus, for test purposes, it is possible to implement triggering of the alarm means 113 and thus functional testing of those alarm means as well as checking of the correct association of the quantities of extinguishing agent.

The alarm means 113 are preferably connected to the control device 1 by means of a respective third control pressure outlet port 35, being supplied with control pressure from a third flow path 34. The third flow path 34 preferably branches from the second flow path 31 downstream of the control valve 33.

The first control valve module 7 has a fourth flow path 41 which is connected in fluid-conducting relationship to the first flow paths 29 downstream of the control valves 33 by means of a plurality of non-return valves 39. An unwanted return flow is prevented by means of the non-return valves 39. Control pressure is transported to the extinguishing agent release module 21 by way of the fourth flow path 41.

A plurality of flow passage columns, for each first control pressure outlet port 17, extend from the extinguishing agent release module 21, through the quantity control module 9 in the form of flow passages 45. The flow passages 45 arranged in columns open into the shut-off elements 15, from which they can be connected in fluid-conducting relationship to flow passages 43 arranged in rows, depending on whether the respective shut-off element 15 is arranged in a closed position (15*b*) or in an open position (15*a*).

The flow passages 43 arranged in rows begin in the first flow paths 29. If the extinguishing agent release module 21 was switched into the open position for the flow passages 45 arranged in columns then control pressure (vertical in relation to the orientation of FIG. 3) can flow through the quantity control module 9. If the control pressure-pressurised gas encounters a shut-off element 15*b* in the closed position it cannot pass into one of the flow passages 43 arranged in rows. The gas can however pass into any flow passage 43 arranged in row form, in which a shut-off element is arranged in the open position 15*a*. In general terms only one row 43 is subjected to pressure. It is however certainly possible for a plurality of rows to be acted upon with pressure. Thus any extinguishing agent containers 107 can be actuated by means of the first control pressure outlet ports 17 and one or more zone valves 111 can be actuated by means of the first control pressure outlet ports 19.

The number m in the quantity control module 9 can be flexibly adapted to the number of extinguishing agent containers 107 to be stocked while the number n in the quantity control module 9 can be adapted as desired to the number of zone valves 111 to be actuated.

Figure 4:
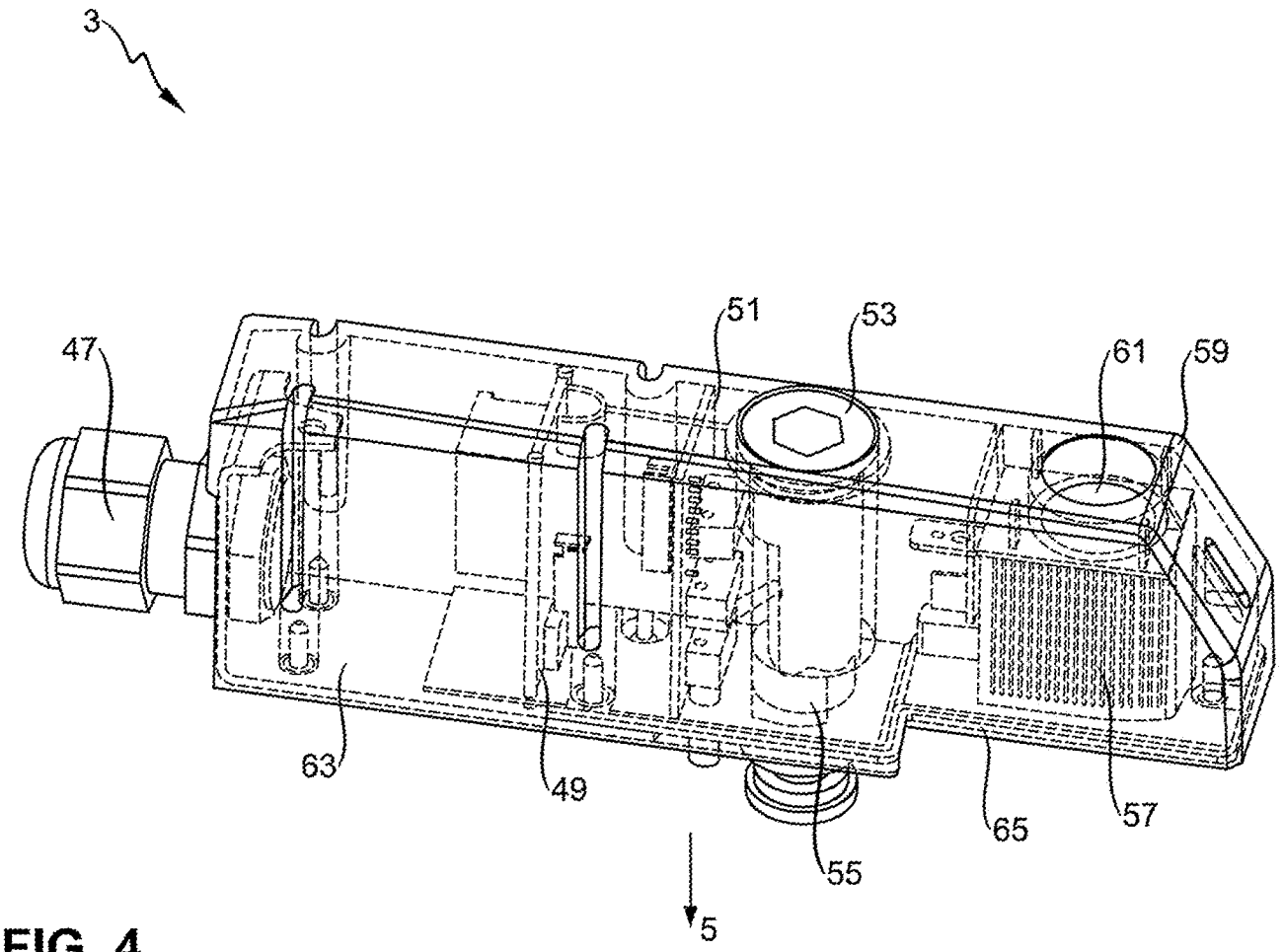
FIG. 4 shows a diagrammatic perspective view of the control unit for the control device shown in FIGS. 2 and 3, FIGS. 5*a* and 5*b* show various diagrammatic perspective views of a control valve module for the control device shown in FIGS. 2 through 4.

FIG. 4 shows the diagrammatic structure of a control unit 3 of the control valve module 7. The control unit 3 has a connection screw means 47, by way of which one or more signal cables can be received. The signal cables are connected by way of a connection circuit board 49 in the control unit 3. The essential signal processing is depicted on a sensor circuit board 51. The sensor circuit board 51 is connected to a coil 57 which is also housed in a housing 59 of the control unit 3. To protect the parts from damage the control unit 3 has a cover plate 63 for the connection circuit board 49 and a further cover plate 65 for the coil 59 and the sensor circuit board 51.

In addition the control unit 3 has a switching shaft 53 and an adaptor shaft 55 for the blocking element 37.

The control unit 3 is adapted to carry out the following functions:

The control unit 3 is adapted to activate the coil 57 and/or to monitor the correct fit of the control unit 3 on the control device 1 and/or to monitor the position "operation" of the blocking element 37 at the respective control pressure outlet port and/or to monitor the position "blocked" of the blocking element 37.

The control unit 3 cooperates with the blocking element 37 in such a way that the switching shaft 53 is mechanically actuated by way of the control unit 3. Preferably provided on the housing 59 of the control unit is an optical indicator, by means of which it is possible to read the position of the switching shaft 53. Optionally that is implemented in the form of an electrical display in conjunction with a mini-switch on the circuit board.

Figure 5A:
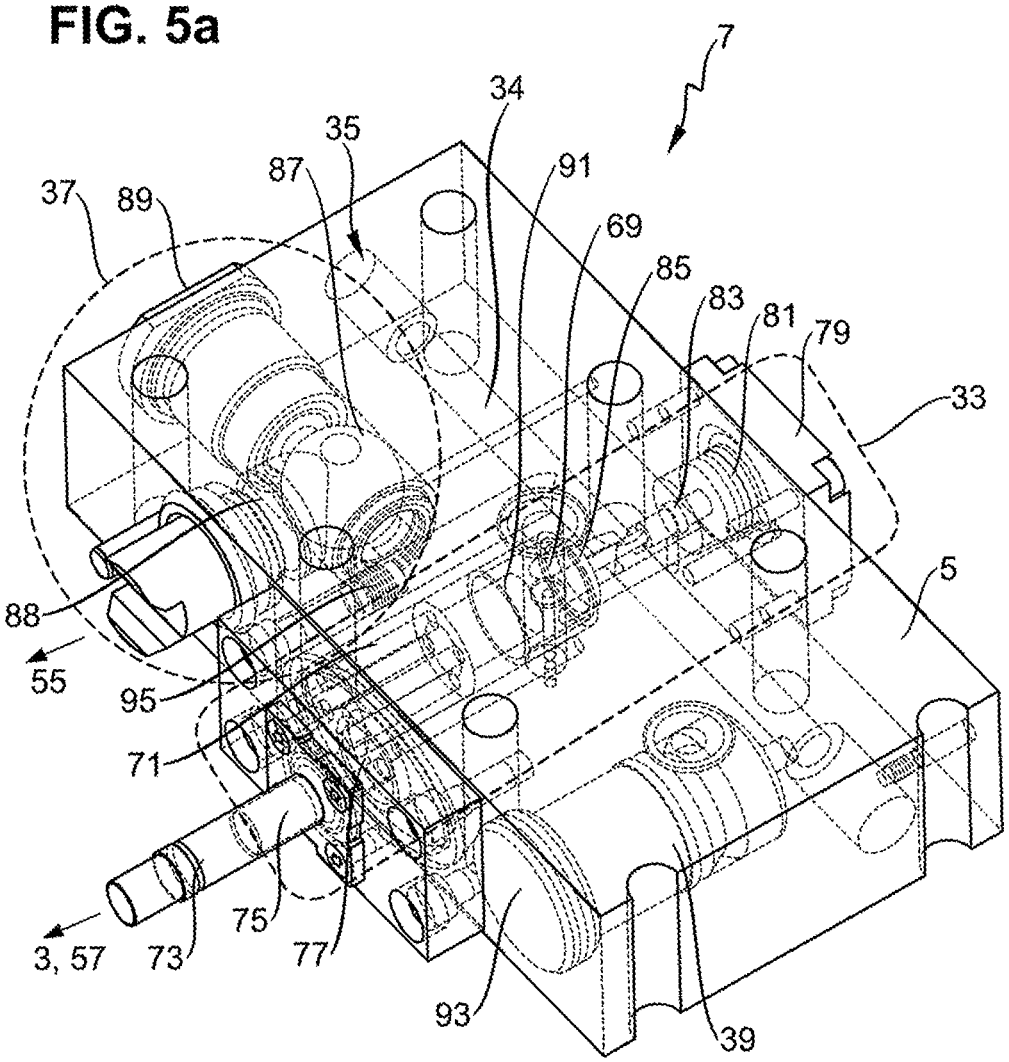

The control unit 3 cooperates by way of the coil 57 with a servo nozzle 77 of the control valve module 7 as shown in FIGS. 5*a, b*.

FIGS. 5*a, b* show a transparent view of the control valve housing 5 of the control valve module 7. Disposed within the control valve housing is the control valve 33, the function of which is controlled by means of the coil 57 of the control unit 3. The control unit 3 is connected to the servo nozzle 77 by means of a sealing seat 73 and a plug 75 and the control valve 33 is disposed in a housing 5 and closed by means of a housing cover 79. The plug 75 is drawn from the servo nozzle 77 by means of actuation of the coil 57 and the control gas passes by way of pressure passages to the control plunger 81. That pushes the control plunger rod 83 against a sealing ball 69 and urges it away from the seal 85. In addition disposed in the interior of the control valve housing 5 is a control ball 87, which can be reciprocated between an open position and a closed position by means of a control ball switching shaft 88. Actuation of the control ball is preferably effected by means of the adaptor shaft 55 of the blocking element. The mode of operation of the control valve module is described hereinafter with reference to FIGS. 5*a, b*.

Figure 5B:
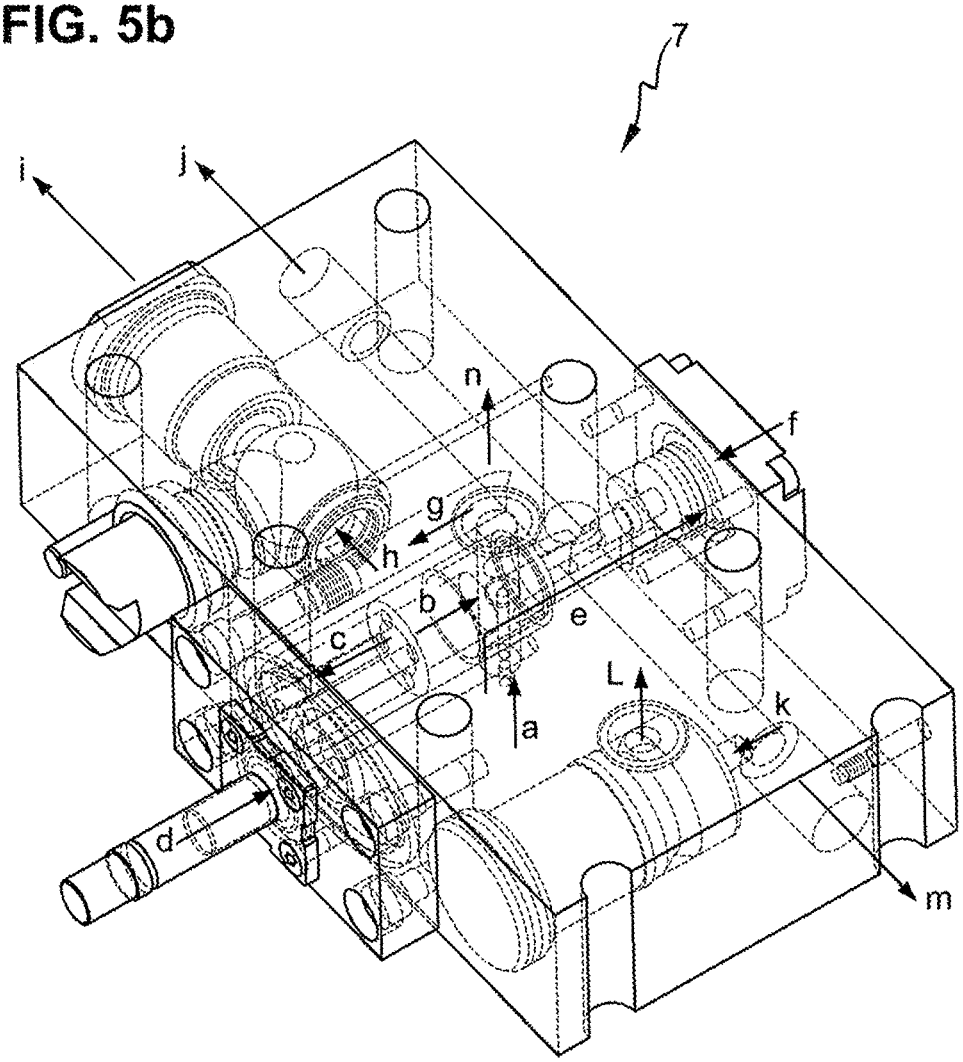

When control pressure occurs at the control valve module 7 (arrow a) it firstly bears against a sealing ball 69 in the interior of the control valve 33. Simultaneously the pressurised control gas is diverted to the further control units 3 of the control valve module 7 by way of a flow passage (in the direction of the arrow n) (FIG. 5*b*). In addition the pressurised control gas also occurs at the servo nozzle 77.

If the coil of the control unit 3 is actuated then the plug 75 is moved against the sealing seat 73 and opens a control passage (arrow e) by way of the servo nozzle 77. The pressurised control gas now flows to the control plunger 81 (arrow f) which acts on the control plunger rod 83 and same pushes the sealing ball 69 back and opens an inlet passage (in the direction of the arrow b). Control gas can now flow by way of that control passage (arrow j) to the respective alarm means 113 or by way of the blocking element 37 in the direction of the second control pressure outlet ports 19 to the zone valves 111 (arrows g, h, i). If flooding of the zone valves 111 by way of the second control pressure outlet ports 19 is to be prevented the control ball switching shaft 88 is actuated to move the control ball 87 into a closed position.

In addition control gas flows (in the direction of the arrow m) into the quantity control module 9 and from there to the extinguishing agent release module 21 in dependence on the position of the shut-off elements 15.

In addition the non-return valve 39 is subjected to control pressure. The non-return valve 39 is held by means of a clamping nut 93. The fluid movement past the non-return valve 39 is indicated by means of the arrows k, L.

Figure 6:
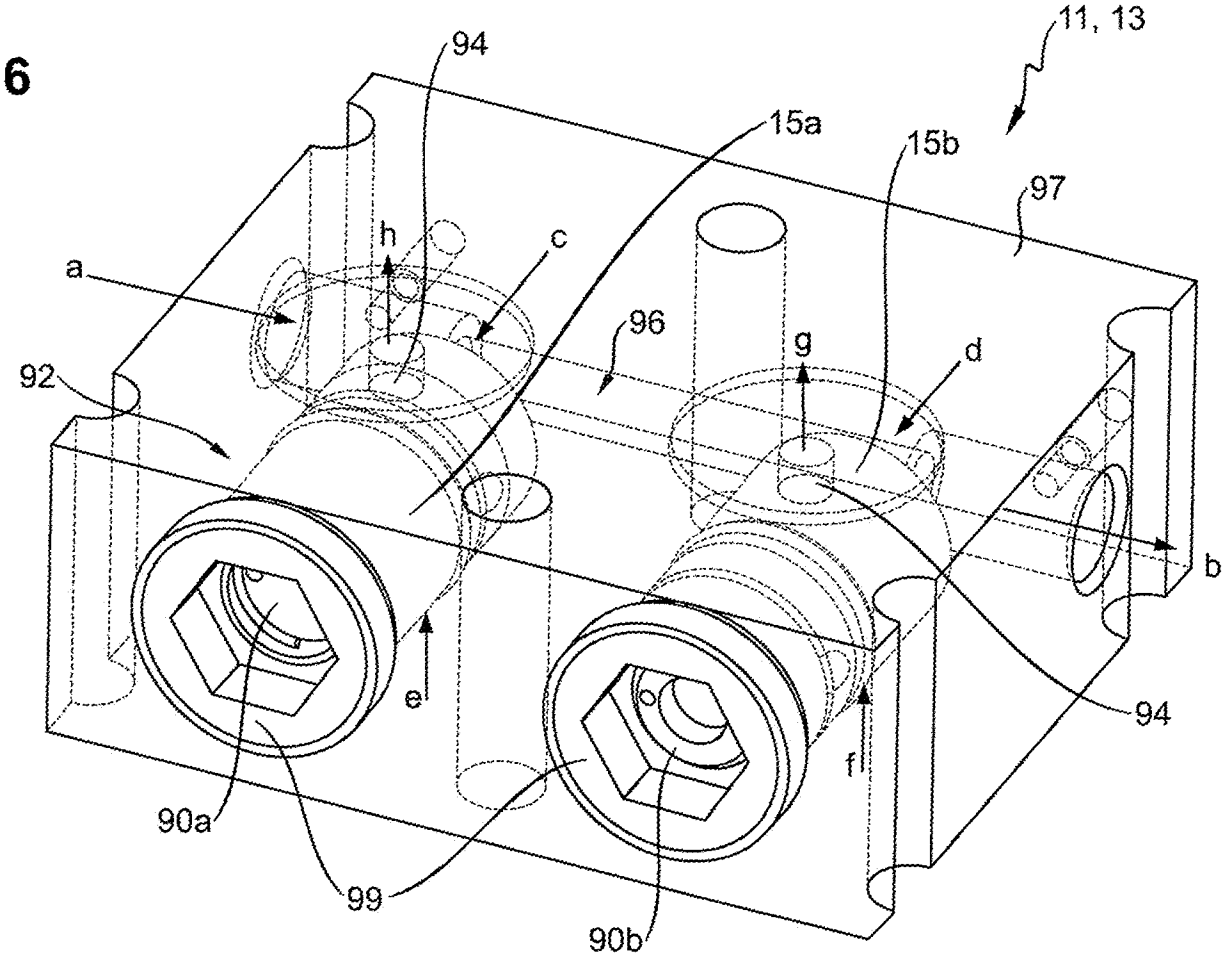
FIG. 6 shows a diagrammatic perspective view of a distributor block for the control device shown in FIGS. 2 and 3.

The fundamental mode of operation of the quantity control module 9 is represented by way of example by reference to a distributor block in FIG. 6. Control pressure flows into the distributor block (in the direction of the arrow a) from the control valve module 7. The shut-off element 15 shown at the left in FIG. 1 is in the open position 15*a*, which is visible from the exterior by an optical indicator 90*a*. Control pressure can therefore pass (in the direction of the arrows c, h) into the flow passage 94 arranged in column form. At the same time the control gas further flows in the flow passage 96 arranged in row form to the next shut-off element which however is arranged in the closed position 15*b*, optionally indicated by a second optical indicator 90*b*. A fluid flow in the direction of the arrows d, g is therefore not possible. The control gas passes out of the housing 97 of the distributor block (in the direction of the arrow b) to the next distributor block.

The shut-off elements 15*a, b* are held in the mounted position by means of a lock ring 99. A change from the closed position to the open position is easily possible by removing the lock ring 99 and reversed re-insertion of the shut-off elements in the positions 15*a, b*. The receiving socket 92 which holds the shut-off elements 15 allows insertion in both orientations.

LIST OF UTILIZED REFERENCE NUMBERS

1 control device
3 control unit
5 control valve housing
7 control valve module
9 quantity control module
11 distributor block (first)
13 distributor block (second)
15 shut-off element
15*a* shut-off element, open position
15*b* shut-off element, closed position
17 control pressure outlet port (first)
19 control pressure outlet port (second)
21 extinguishing agent release module
22 release valve
23 service/reserve switching module
25 control pressure inlet port
27 main body
29 flow path (first)
31 flow path (second)
33 control valve
34 flow path (third)
35 control pressure outlet port (third)
37 blocking element
39 non-return valve
41 flow path (fourth)
42 delay valve
43 flow passage row
45 flow passage column
47 connection screw means
49 connection circuit board
51 sensor circuit board
53 switching shaft (blocking valve)
55 adaptor shaft (blocking valve)
57 coil
59 housing
61 hexagonal nut
63 cover plate (board)
65 cover plate (sensor, coil)
69 sealing ball
71 spacer sleeve
73 sealing seat
75 plug
77 servo nozzle
79 control housing cover
81 control plunger
83 control plunger rod
85 seal
87 control ball
88 control ball switching shaft
89 sealing pin
90*a,b* optical indicator
91 valve sleeve
92 receiving socket
93 clamping nut
94 flow passage column
95 plug
96 flow passage row
97 housing (distributor block)
99 lock ring
100 multi-zone fire extinguishing installation
101 fire identifier detector
103 fire alarm and/or extinguishing control station
105 control pressure source
107 extinguishing agent container
109 piping network
111 zone valve
113 alarm means
m number of first control pressure outlet ports
n number of second control pressure outlet ports

The invention claimed is:

1. A pneumatic control device for multi-zone fire extinguishing installations, comprising:
- a control pressure inlet port for connection to a control pressure source,
- a number of first control pressure outlet ports for connection to a corresponding number of extinguishing agent containers,
- a number of second control pressure outlet ports for connection to a corresponding number of zone valves, and
- a plurality of function modules including:
- a quantity control module for an association of a selection of one or more of the first number of control pressure outlet ports with a selection of one or more of the second control pressure outlet ports, and
- an electrical control valve module which is controllable from an exterior for selectively opening or closing the second control pressure outlet ports and which can be connected to be in signal communication with a fire alarm and/or extinguishing control station,
- wherein the plurality of function modules are operatively connected together.

2. A control device as set forth in claim 1 wherein the plurality of function modules are assembled to form a unit.

3. A control device as set forth in claim 1 wherein the quantity control module has a plurality of first flow paths between the control pressure inlet port and the first control pressure outlet ports and each first flow path has a shut-off element which can selectively assume a closed state in which the respective first flow path is closed or an open state in which the respective first flow path is opened.

4. A control device as set forth in claim 3 wherein each shut-off element has an optical indicator which displays the closed and/or open state.

5. A control device as set forth in claim 1 wherein the number of first control pressure outlet ports includes two or more outlet ports and the number of second control pressure outlet ports includes two or more outlet ports.

6. A control device as set forth in claim 3 wherein the shut-off elements are fitted in distributor blocks, and wherein the distributor blocks are mounted in mutually adjoining relationship and have flow passages to the respectively adjacent distributor blocks.

7. A control device as set forth in claim 6 wherein each distributor block accommodates either two or three shut-off elements.

8. A control device as set forth in claim 3 wherein the shut-off elements are arranged in a switching matrix having rows and columns.

9. A control device as set forth in claim 8 wherein the quantity control module has flow passages for each row and flow passages for each column, wherein between the control pressure inlet port and the first outlet ports, the first flow paths pass through said flow passages, and the shut-off elements are respectively arranged at an interface between a row having a flow passage and a column having a flow passage in order in the open state to enable a transfer from the row into the column and in the closed state to block the transfer.

10. A control device as set forth in claim 3 wherein the shut-off elements comprise non-return valves which are fitted into a receiving socket, wherein a first orientation of non-return elements produces the open state and a second orientation produces the closed state.

11. A control device as set forth in claim 1 wherein the control valve module has the second control pressure outlet ports, a plurality of first flow paths between the quantity control module and the second control pressure outlet ports, a plurality of second flow paths between the control pressure inlet port and the second control pressure outlet ports and for each of the second control pressure outlet ports a control valve which is arranged between the control pressure inlet port and the second control pressure outlet ports and is reciprocatingly switchable between an open position and a closed position.

12. A control device as set forth in claim 11 wherein the first and second flow paths extend jointly to the respective control valve in the control valve module and downstream thereof branch from each other.

13. A control device as set forth in claim 11 wherein the control valve module has a number of third flow paths and connected thereto third control pressure outlet ports for connection to a corresponding number of alarms, and wherein the third control pressure outlet ports branch from the plurality of second flow paths downstream of the control valves.

14. A control device as set forth in claim 13 wherein the control valve module in each of the second flow paths, downstream of the branching to the third flow paths, has a blocking element for selectively shutting off one, more or all of the second control pressure outlet ports.

15. A control device as set forth in claim 14 comprising a extinguishing agent release module as a further function module which is arranged in adjoining relationship downstream of the quantity control module, and for each first control pressure outlet port has a release valve which is arranged upstream at the first control pressure outlet ports and is reciprocatingly switchable between an open position and a closed position.

16. A control device as set forth in claim 15 wherein the release valves are pilot-controlled by a delay valve, wherein the delay valve can be connected to a control pressure supply by a fourth flow path, wherein further the fourth flow path branches from the first or second flow path.

17. A control device as set forth in claim 15 comprising a service/reserve switching module as a further function module, which is arranged downstream at the quantity control module in adjoining relationship downstream of the extinguishing agent release module, and is adapted to fluid-conductingly connect the first control pressure outlet ports selectively to a number of service extinguishing agent containers or a number of reserve extinguishing agent containers.

18. A multi-zone fire extinguishing installation comprising a plurality of fire identification detectors which are respectively arranged in a region of an object to be monitored, a fire alarm and/or extinguishing control station connected in signal-conducting relationship to the fire identification detectors, a number of extinguishing agent containers, a piping network connected to the extinguishing agent containers for transporting the extinguishing agent, wherein the piping network has a number of zone valves, and a control pressure source, and a control device which is in accordance with claim 1 and is connected to the fire alarm and/or extinguishing control station in signal-conducting relationship and is controlled thereby.

* * * * *